US005762431A

United States Patent [19]

Pawelka et al.

[11] Patent Number: 5,762,431

[45] Date of Patent: Jun. 9, 1998

[54] THERMAL PRINTER AND METHOD FOR USING

[75] Inventors: Gerhard Eduard-Franz Pawelka, Lexington; Jesse Erin Ambrosina, Somerville, both of Mass.

[73] Assignee: Datacard Corporation, Minneapolis, Minn.

[21] Appl. No.: 797,873

[22] Filed: Feb. 10, 1997

[51] Int. Cl.[6] ..... B41J 13/10

[52] U.S. Cl. ..... 400/642; 347/215; 347/218; 271/225; 271/902

[58] Field of Search ..... 400/642, 120.16, 400/625; 271/225, 902, 264; 347/215, 216, 217, 218

[56] References Cited

U.S. PATENT DOCUMENTS

| | | | |
|---|---|---|---|
| 4,189,135 | 2/1980 | Cota | 400/625 |
| 4,594,597 | 6/1986 | Liu et al. | 400/625 |
| 4,619,197 | 10/1986 | Pailler | 400/625 |
| 4,932,798 | 6/1990 | Kardinal et al. | 400/642 |
| 5,296,874 | 3/1994 | Nagata et al. | 400/642 |
| 5,547,183 | 8/1996 | Tamura | 271/264 |
| 5,645,362 | 7/1997 | Aizawa et al. | 347/215 |

*Primary Examiner*—Eugene H. Eickholt

*Attorney, Agent, or Firm*—Merchant, Gould Smith, Edell Welter & Schidt, P.A.

[57] ABSTRACT

The present invention relates to a thermal printer for printing a card. The printer includes a housing having an input/output end configured for both inputting the card into the housing and outputting the card from the housing. A print head is positioned within the housing for printing the card. A card input station and a card output station are located at the input/output end of the housing. A stationary diverter ramp is positioned between the input/output end of the housing and the print head. The diverter ramp has a sloped diverting surface generally facing away from the input/output end of the housing. The printer is also equipped with a mechanism for feeding the card from the input station, past the diverter ramp, to the print head. The printer further includes a mechanism for reversing direction of the card and feeding the card from the print head back towards the diverter ramp such that the card engages the sloped diverting surface of the diverter ramp and is directed toward the output station.

11 Claims, 5 Drawing Sheets

THERMAL PRINTER AND METHOD FOR USING

FIELD OF THE INVENTION

The present invention relates generally to thermal printers for printing substrates such as plastic cards. More specifically, the present invention relates to thermal printers having input and output stations located on the same side of the printer.

BACKGROUND OF THE INVENTION

Thermal printers are used to print graphic images on substrates such as cards, webs, and other receptor materials. A typical thermal printer includes a thermal print head having a single column or row of dots. The dots are resistive elements that, when activated, heat a transfer ribbon and transfer thermally reactive inks or dyes from a carrier ribbon to a given substrate.

A conventional thermal printer for printing cards generally has a card path that starts at one end of the printer and ends at another end of the printer. This is not desirable from a user's perspective since it forces the user to load cards at one end of the printer, and then retrieve finished cards from the other end of the printer. To alleviate this problem, thermal printers are sometimes built with a "folded" card path to bring the finished cards back to the same side as where they were loaded. This folding of the card path involves complicated mechanisms to shuttle the card from an input leg of the card path to an output leg of the card path. In other words, the mechanisms move the card from its original path to a new path. Machines have also been built which make use of a movable diverter to move the card from one path to another. The common element in each of these card printing machines relates to the complicated moving mechanisms that are required to move the card from one path to another.

SUMMARY OF THE INVENTION

The present invention relates generally to a thermal printer for printing an image on a card. The card may be made of plastic, a paper/plastic composite, paper coated with plastic, or any other material suitable for thermal printing. The thermal printer includes a housing having an input/output end configured for both inputting the card into the housing and outputting the card from the housing. A print module, including a thermal print head, is located within the housing for printing the card. Positioned between the print module and the input/output end of the housing is a stationary diverter ramp. The stationary diverter ramp has a sloped diverting surface that faces generally away from the input/output end of the housing. The printer is also equipped with means for feeding the card from an input station located at the input/output end of the housing, past the diverter ramp, to the printer module. The printer further includes means for reversing direction of the card and feeding the card from the print module back towards the diverter ramp such that the card engages the sloped diverting surface of the diverter ramp and is diverted toward an output station located at the input/output end of the housing.

Another aspect of the present invention relates to a method for printing a card with a thermal printer. The method includes the step of inputting the card in a first end of the thermal printer. Next, the card is moved from the first end of the printer toward a print module, including a thermal print head, located within the printer. As the card is moved toward the print module, the card is guided past a stationary diverter ramp positioned between the first end of the printer and the print module. Once the card reaches the print module, the card is printed. After the card is printed, the card is moved from the print module back toward the first end of the thermal printer. As the card is moved toward the first end of the printer, the card is diverted with a stationary diverter ramp such that the card is directed toward an output station located at the first end of the printer.

In general terms, the present invention provides a path that allows a receptor substrate, such as card, to enter and exit the same end of a thermal printer without the need for a shuttle or complicated mechanism to move the substrate from one path to another path. The inventive path incorporates a fixed or passive diverter. The fixed diverter makes it possible to manufacture a simple, reliable, dependable, and low maintenance thermal printer which has an auto feed input and output stacker located on the same side of the printer.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
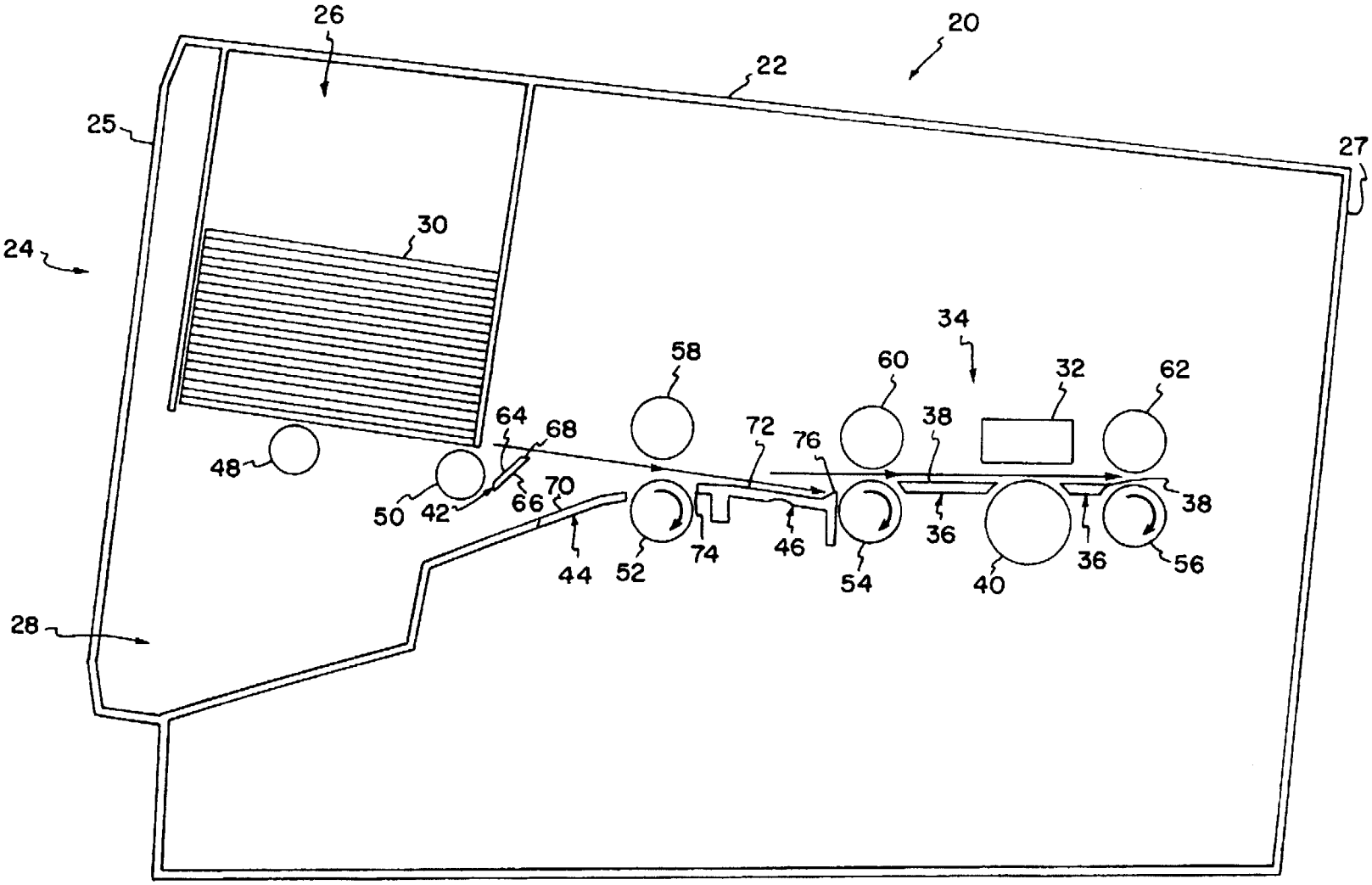
FIG. 1 is a schematic illustration of an exemplary thermal printer constructed in accordance with the principles of the present invention, arrows have been provided showing the card input path of the printer.
Figure 2:
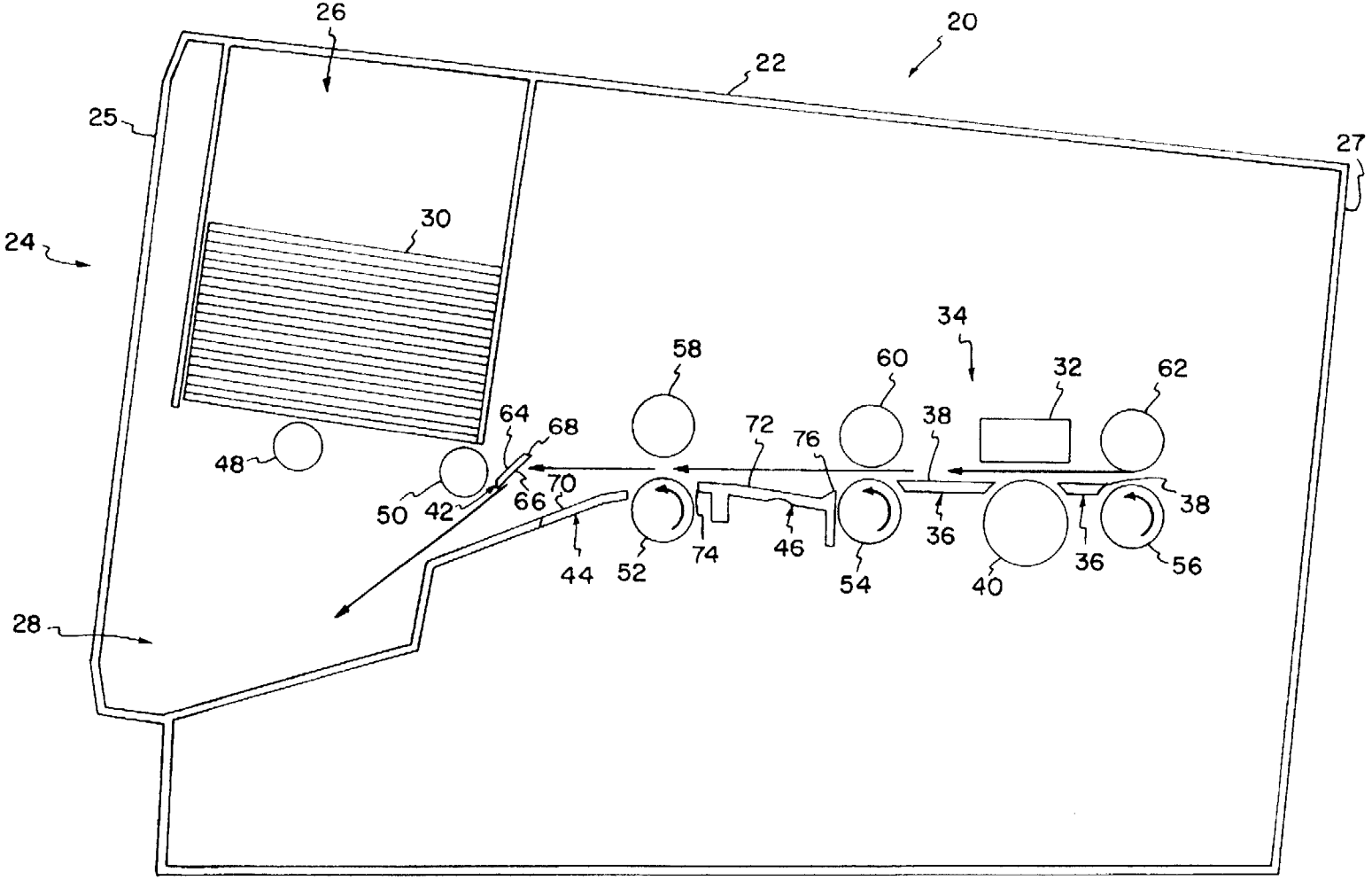
FIG. 2 is a schematic illustration of the thermal printer of FIG. 1, arrows have been provided showing the card output path of the printer.

FIGS. 1 and 2 schematically illustrate a thermal printer 20 constructed in accordance with the principles of the present invention. The thermal printer 20 includes a housing 22 having an input/output end 24 including an input station 26 for feeding cards into the printer and an output station 28 for receiving printed cards from a printer. For convenience in describing the Figures, the input/output end 24 of the printer 20 will be described as being located at a front end 25 of the housing 22 while the opposite end of the housing 22 will be referred to as a back end 27.

In FIGS. 1 and 2, the input station 26 is shown supporting a stack of cards 30 awaiting to be fed into the printer 20. It is preferred for the input and output stations 26 and 28 to comprise hoppers that are readily removable from the input/output end 24 of the housing 22.

The thermal printer 20 also includes a print module 32 positioned within the housing 22. The print module 32 preferably includes a thermal print head that provides a plurality of resistive dot elements. The dot elements are used to selectively heat a transfer ribbon which transfers a thermally reactive dye or ink from a carrier ribbon to a card positioned adjacent to the print head. Representative print head manufacturers include Toshiba International Corporation, Kyocera Electronics, Inc, Ricoh Company, TDK Corporation, and others.

The thermal printer 20 also includes a printing region 34 positioned adjacent to the print module 32. The printing region 34 includes a printing platform 36 having a top surface comprising a substantially planar printing surface 38 configured for supporting a card while the card is being printed. At an intermediate location of the printing platform 36, the printing platform 36 defines an opening through which a print roller 40 projects. The print roller 40 is preferably aligned with the dots of the thermal print head and the rotation of the print roller 40 is preferably coordinated with the printer 32. Consequently, the print roller 40 is constructed and arranged to control the positioning of a card desired to be printed relative to the printer 32.

The thermal printer 20 also includes a stationary diverter ramp 42, a stationary output ramp 44, and an intermediate guide ramp 46. The diverter ramp 42, the output ramp 44, and the guide ramp 46, cooperate to passively guide cards along an input path (shown in FIG. 1) and along an output path (shown in FIG. 2). Cards are fed through the printer 20 by first and second pick rollers 48 and 50 which are positioned below the input station 26, a first driven roller 52 positioned between the output ramp 44 and the guide ramp 46, a second driven roller 54 positioned between the guide ramp 46 and the printing platform 36, and a third driven roller 56 positioned at the back end of the printing platform 36. Corresponding first, second, and third idler rollers 58, 60, and 62 are respectively positioned above the first, second, and third driven rollers 52, 54, and 56.

The diverter ramp 42 of the thermal printer 20 is positioned below the input station 26 and includes a front surface 64 that generally faces the input/output 24 of the housing 22, and a back surface 66 that generally faces the back end 27 of the housing 22. The front surface 64 is constructed and arranged to guide cards from the input station 26 over a top edge 68 of the diverter ramp 42. The back surface 66 of the diverter ramp 42 is constructed and arranged to divert printed cards to the output station 28.

The stationary output ramp 44 of the printer 20 is positioned between and generally below the diverter ramp 42 and the guide ramp 46. The output ramp 44 includes an output guide surface 70 that generally faces the back surface 66 of the diverter ramp 42. The output ramp 44 is constructed and arranged to guide cards that are diverted by the back surface 66 of the diverter ramp 42 into the output station 28.

The intermediate guide ramp 46 of the card printing machine 20 is positioned between the first and second driven rollers 52 and 54. The top of the guide ramp 46 defines a primary guide surface 72 for guiding cards between the first and second driven rollers 52 and 54. The intermediate guide ramp 46 also includes a top front edge 74 positioned adjacent to the first driven roller 52 and a top back edge 76 positioned adjacent to the second driven roller 54. The back portion of the intermediate guide ramp 46 tapers upward to guide cards into the nip between the second drive roller 54 and the second idler roller 60.

As shown in FIGS. 1 and 2, the top edge 68 of the diverter ramp 42, the primary guide surface 72 of the intermediate guide ramp 46, and the top portions of the first pick roller 48, the second pick roller 50, and the first driven roller 52, are all aligned substantially along a single input path plane. Also, the printing surface 38 of the printing platform 36, the top front edge 74 of the intermediate guide ramp 46, and the upper portions of the first, second, and third driven rollers 52, 54, and 56, are aligned generally along a single output path plane that intersects with the back surface 66 of the stationary diverter ramp 42. The above-described arrangement insures minimal bending of the card as it is fed through the thermal printer 20.

In basic operation, a card is picked from the bottom of the card stack 30 by the pick rollers 48 and 50 and fed over the top edge 68 of the stationary diverter ramp 42. The front surface 64 of the diverter ramp 42 is angled such that if the leading edge of the card contacts the front surface 64, the card is guided over the top edge 68 of the diverter ramp 42. The pick rollers 48 and 50 feed the card past the top edge 68 of the diverter ramp 42 and into the nip defined between the first driven roller 52 and the first idler roller 58.

Once the leading edge of the card enters the nip between the first driven roller 52 and the first idler roller 58, the first driven roller 52 feeds the card toward the intermediate guide ramp 46. The card remains oriented along the input path plane defined by the top edge 68 of the diverter ramp 42 and the guide surface 72 of the intermediate guide ramp 46 until the trailing edge of the card passes the top edge 68 of the diverter ramp 42 and the leading edge of the card contacts the tapered portion at the back end of the intermediate guide ramp 46.

Once the trailing edge of the card passes the top edge 68 of the diverter ramp 42, the first driven roller 52 and the tapered back end of the intermediate guide ramp 46 cooperate to move the card to a plane substantially parallel to the printing surface 38 of the printing platform 36. The leading edge of the card is then fed into the nip formed between the second driven roller 54 and the second idler roller 60. Next, the second driven roller 54 feeds the card into the printing region 34 where the card is printed by the print module 32.

After the card is printed by the print module 32, the first, second, and third driven rollers 52, 54, and 56 reverse directions and move the card from the back end 27 of the housing 22 toward the front end 25 of the housing 22. As the card is moved in the output direction, the card travels along the output path plane aligned generally along the printing surface 38 of the printing platform 36 and the top front edge 74 of the intermediate guide ramp 46. The card remains oriented on the output path plane of the printing surface 38 until the leading edge of the card engages the back surface 66 of the stationary diverter ramp 42. Upon engagement with the back surface 66 of the diverter ramp 42, the card is directed downward toward the stationary output ramp 44. The output guide surface 70 of the stationary output ramp 44 guides the card downward to the output station 28. Once the printed card has been stored in the output station, the next card from the stack 30 is fed towards the print module 32 and the cycle is repeated.

During operation of the printer 20, as described in the above paragraphs, the card experiences minimal bending. Specifically, during input, the card is aligned at an angle with respect to the printing path until its trailing edge passes the diverter ramp 42. After passing the diverter ramp 42, the card straightens out along the print path. During output, the card follows the straight print path until it is diverted by the diverter 42. The substantially planar paths followed by the card minimize card bending and assist in maintaining contact between the card and the driven rollers 52, 54, and 56.

Figure 3:
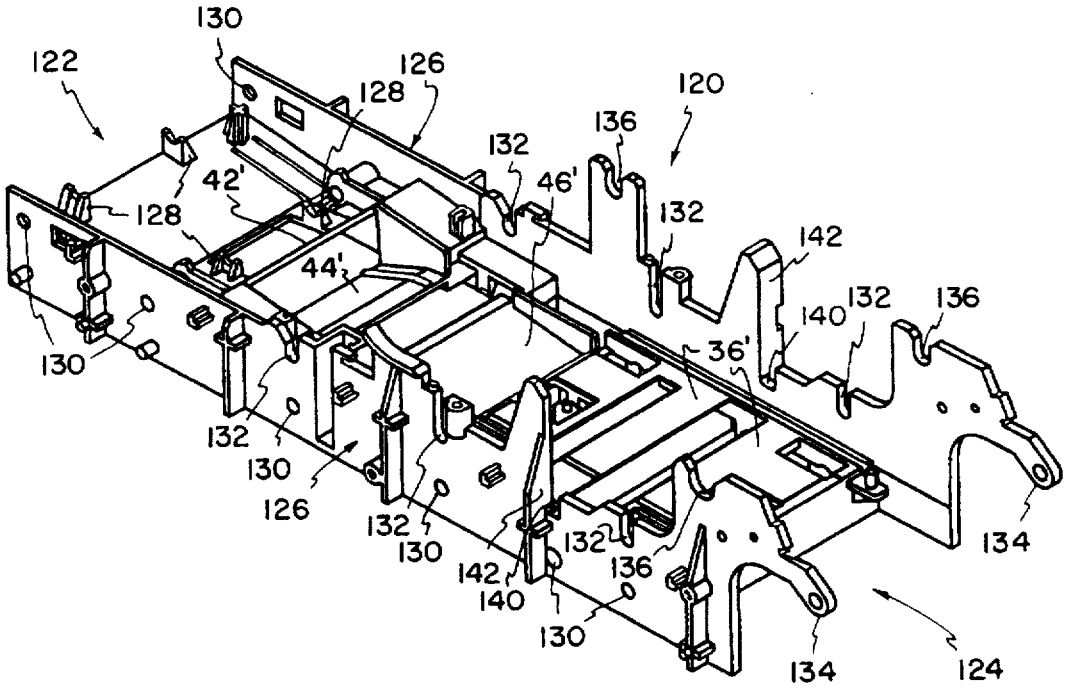
FIG. 3 is a perspective view of an exemplary unitary chassis defining a card path constructed in accordance with the principles of the present invention.
Figure 4:
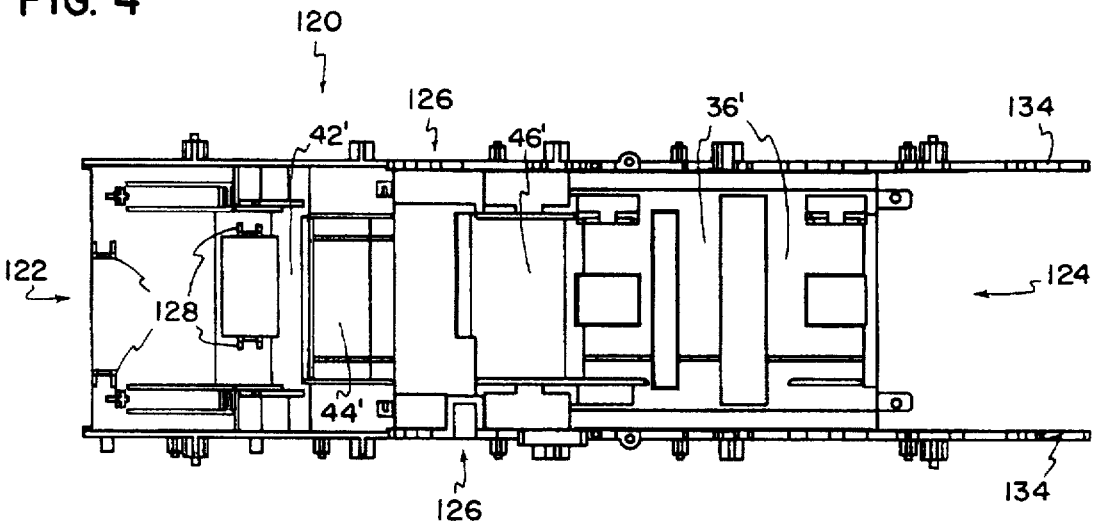
FIG. 4 is a top view of the chassis of FIG. 3.
Figure 5:
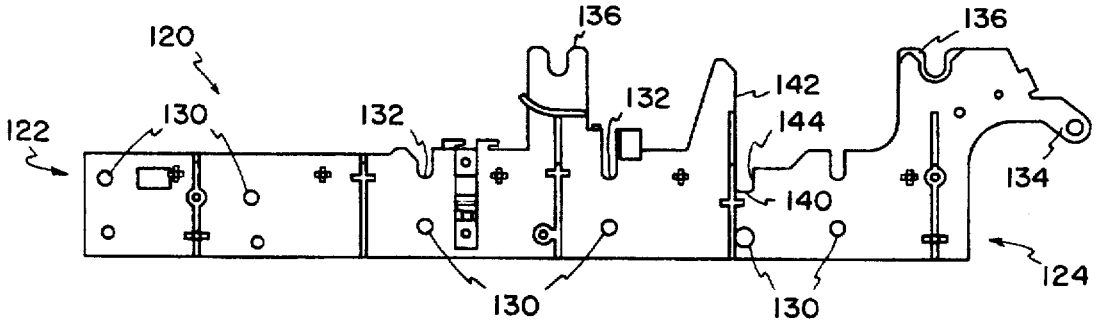
FIG. 5 is a side view of the chassis of FIG. 3.

FIGS. 3–5 illustrate a one-piece printer chassis 120 constructed in accordance with the principles of the present invention. The printer chassis 120 has a first end 122 positioned opposite from a second end 124. Opposing sidewalls 126 extend between the first and second ends 122 and 124. Similar to the schematic embodiment disclosed in FIGS. 1 and 2, the printer chassis 120 includes a stationary diverter ramp 42', a stationary output ramp 44', an intermediate guide ramp 46', and a printing platform 36'.

The chassis 120 preferably also includes structure for connecting rollers to the chassis 120. For example, a plurality of mounts 128 for limiting lateral movement of the rollers are unitarily formed with the chassis 120. Additionally, the sidewalls 126 define a plurality of openings 130 in which the shafts of driven rollers can be journaled. Furthermore, the chassis 120 includes a plurality of elongated vertical slots 132 in which the shafts of idler rollers can be journaled. It will be appreciated that the chassis is also equipped with a plurality of roller openings defined adjacent to at least some of the openings 130 in the sidewalls 126 for allowing the different rollers journaled in the sidewalls 126 to project into the card path defined by the chassis 120.

The chassis 120 further includes structure for mounting printing equipment on the chassis 120. For example, the second end 124 of the chassis includes a pair of arms 134 having apertures for pivotally connecting a print module to the chassis 120. The chassis 120 also includes elevated support members 136 having slots configured for rotatably mounting reels on which a ribbon containing transfer ink can be wound. Furthermore, the chassis 120 includes alignment slots 140 and opposing first and second alignment surfaces 142 and 144 for aligning a print head at a particular location on the chassis 120. The alignment slots 140 are located at the sidewalls 126 of the chassis 120 adjacent the printing platform 36'.

Figure 6:
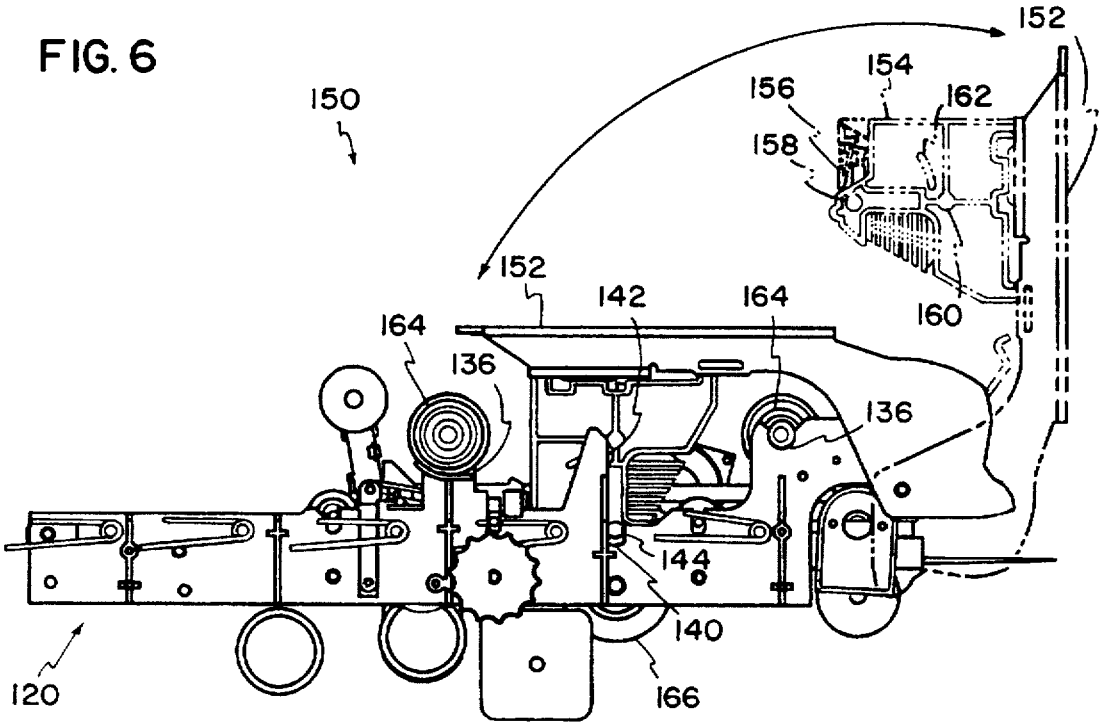
FIG. 6 shows a printer incorporating the chassis of FIGS. 3–5.

FIG. 6 shows a thermal printer 150 incorporating the chassis 120. The printer 150 includes a pivot arm 152 pivotally mounted on the mounting arms 134 of the chassis 120. A print module including a carriage 154 containing a thermal print head 156 is mounted on the arm 152. The carriage 154 includes two sets of first and second alignment pins 158 and 160 (one set of alignment pins is shown) which project laterally outward from opposite sides of the carriage. The print head 156 is positioned at a predetermined location relative to the first and second sets of mounting pins 158 and 160. The positioning of the print head 156 can be controlled by sliding the print head along adjustment slots 162 defined by the carriage 154.

The pivot arm 152 of the thermal printer 150 is pivotally movable between a non-printing position and a printing position. When the arm 152 is in the printing position, the first alignment pins 158 are positioned within the slots 140 of the chassis 120 to control the vertical orientation of the print head 156. Also, the first alignment pins 158 are preferably biased against the second alignment surfaces 144 of the chassis 120, while the second alignment pins 160 are preferably biased against the first alignment surfaces 142 of the chassis 120. In this manner, the opposing alignment surfaces 142 and 144 control the alignment of the print head 156 relative to the printing platform 36'.

As shown in FIG. 6, the thermal printer 150 also includes ink or dye ribbon reels 164 mounted in the elevated members 136 of the chassis 120. Additionally, a print roller 166 is shown mounted directly below the alignment pins 158 and 160 of the print head carriage 154.

While the specifically illustrated embodiments of the present invention disclosed using rollers for moving cards through the chassis 120, it will be appreciated that alternative structures such as belts or other conventionally known feeding structures may also be used without departing from the principles of the present invention. Also, throughout the specification, the various embodiments have been described as being used in association with "cards". It will be appreciated that the term cards includes substrates of various sizes made of various materials such as plastic, paper coated with plastic, plastic/paper composites, and any other materials and composites thereof suitable for thermal printing. Furthermore, embodiments of the present invention can be incorporated into various systems. Exemplary systems include optional magnetic stripe encoding and smart card initializing stations for imparting information to magnetic stripes or integrated circuits associated with cards being printed.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A thermal printer for printing a substrate, the printer comprising:

a housing having an input/output end configured for both inputting the substrate into the housing and outputting the substrate from the housing;

a print head positioned within the housing for printing the substrate;

an input station positioned at the input/output end of the housing;

an output station positioned at the input/output end of the housing;

a stationary diverter ramp positioned between the input/output end of the housing and the print head, the diverter ramp having a sloped diverting surface generally facing away from the input/output end of the housing;

a transport mechanism constructed and arranged to move the substrate from the input station, past the diverter ramp, to the print head, and to reverse direction of the substrate and move the substrate from the print head back towards the diverter ramp such that the substrate engages the sloped diverting surface of the diverter ramp and is diverted toward the output station.

2. The printer of claim 1, wherein the transport mechanism includes a printing platform positioned adjacent to the print head for supporting the substrate as the substrate is printed, and an intermediate ramp positioned between the diverter ramp and the printing platform for guiding the substrate as the substrate travels between the diverter ramp and the printing platform.

3. The printer of claim 2, wherein the printing platform, the intermediate ramp, and the diverter ramp are unitarily formed as a one-piece unit.

4. The printer of claim 2, wherein at least a portion of the printing platform is aligned generally along an output path plane that intersects the diverting surface of the diverter ramp, and the intermediate ramp includes a guide portion generally aligned with the output path plane.

5. The printer of claim 2, wherein the transport mechanism further includes a pick roller positioned at the input station, a first driven roller positioned between the diverter ramp and the intermediate ramp, and a second driven roller positioned between the intermediate guide ramp and the printing platform.

6. A thermal printer for printing a substrate, the printer comprising:

a housing having an input/output end configured for both inputting the substrate into the housing and outputting the substrate from the housing;

a print head positioned within the housing for printing the substrate;

an input hopper positioned at the input/output end of the housing;

an output hopper positioned at the input/output end of the housing below the input hopper;

a stationary diverter ramp positioned between the input/output end of the housing and the print head, the diverter ramp having a front side generally facing the input/output end of the housing, and a back side generally facing away from the input/output end of the housing;

a printing platform positioned adjacent to the print head, at least a portion of the printing platform being aligned along an output path plane that intersects the back side of the diverter ramp; and an intermediate ramp positioned between the diverter ramp and the printing platform for guiding the substrate as it travels between the diverter ramp and the printing platform.

7. The printer of claim 6, wherein a portion of the intermediate ramp is aligned with the output path plane.

8. The printer of claim 6, wherein the intermediate ramp is positioned below the diverter ramp, the intermediate ramp includes a guide surface aligned along an input path plane, the diverter ramp has a top edge over which the substrate is fed when inputted from the input station, and the top edge is aligned generally with the input path plane.

9. A printer for printing a substrate, the printer comprising:

a housing having an input/output end configured for both inputting the substrate into the housing and outputting the substrate from the housing;

a print head positioned within the housing for printing the substrate;

an input station positioned at the input/output end of the housing;

an output station positioned at the input/output end of the housing;

a stationary diverter ramp positioned between the input/output end of the housing and the print head, the diverter ramp having a sloped diverting surface generally facing away from the input/output end of the housing;

means for feeding the substrate from the input station, past the diverter ramp, to the print head; and means for reversing direction of the substrate and feeding the substrate from the print head back towards the diverter ramp such that the substrate engages the sloped diverting surface of the diverter ramp and is diverted toward the output station.

10. A method for printing a substrate with a thermal printer, the printer including an input/output end having an input station and an output station, a print head, and a stationary diverter ramp positioned between the input/output end and the print head, the method comprising the steps of:

inputting the substrate in the input station of the input/output end of the printer;

moving the substrate from the input station of the printer toward the print head;

guiding the substrate past the stationary diverter ramp to a print region located generally adjacent to the print head;

printing the substrate at the print region;

moving the substrate from the print region toward the input/output end of the printer;

diverting the substrate with the stationary diverter ramp such that the substrate is directed toward the output station of the printer.

11. The method of claim 10, wherein the substrate comprises a plastic card.

* * * * *